US011043761B2

(12) United States Patent
Miyamoto

(10) Patent No.: US 11,043,761 B2
(45) Date of Patent: Jun. 22, 2021

(54) CONNECTOR

(71) Applicant: SUMITOMO WIRING SYSTEMS, LTD., Yokkaichi (JP)

(72) Inventor: Takeru Miyamoto, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 83 days.

(21) Appl. No.: 16/498,705

(22) PCT Filed: Apr. 2, 2018

(86) PCT No.: PCT/JP2018/014079
§ 371 (c)(1),
(2) Date: Sep. 27, 2019

(87) PCT Pub. No.: WO2018/186338
PCT Pub. Date: Oct. 11, 2018

(65) Prior Publication Data

US 2021/0104829 A1 Apr. 8, 2021

(30) Foreign Application Priority Data

Apr. 7, 2017 (JP) ..... JP2017-076953

(51) Int. Cl.
*H01R 12/00* (2006.01)
*H01R 9/16* (2006.01)
(Continued)

(52) U.S. Cl.
CPC ..... *H01R 9/16* (2013.01); *H01R 9/11* (2013.01); *H01R 11/12* (2013.01); *H01R 2201/10* (2013.01)

(58) Field of Classification Search
CPC ..... H01R 13/6658; H01R 2201/26; H01R 13/53; H01R 13/743; H01R 23/7073
(Continued)

(56) References Cited

U.S. PATENT DOCUMENTS 8,491,335 B2 * 7/2013 Matsumoto ..... H01R 13/506 439/587
9,653,843 B2 * 5/2017 Suzuki ..... H01R 13/58
(Continued)

FOREIGN PATENT DOCUMENTS

JP H06-295769 A 10/1994
JP 2003-115357 A 4/2003
(Continued)

OTHER PUBLICATIONS

Jul. 3, 2018 International Preliminary Report on Patentability issued in International Patent Application No. PCT/JP2018/014079.
(Continued)

*Primary Examiner* — Phuong Chi Thi Nguyen
(74) *Attorney, Agent, or Firm* — Oliff PLC

(57) ABSTRACT

A connector attached to a device, includes a main body made from resin and having an annular shape, a wire including a terminal, and a shield shell that covers at least a portion of the main body. The shield shell is fixed to the device such that a gap exists between the shield shell and the main body. Protrusions are provided on at least one of (i) a section of the shield shell covering the main body or (ii) a section of the main body covered by the shield shell, the protrusions protruding toward the section of the shield shell or the section of the main body. The protrusions surround a fastening position where the terminal and the terminal fixing section are fastened together.

6 Claims, 4 Drawing Sheets

(51) Int. Cl.
*H01R 9/11* (2006.01)
*H01R 11/12* (2006.01)

(58) Field of Classification Search
USPC ..... 439/76.1, 76.2, 34, 475, 557, 660
See application file for complete search history.

(56) References Cited

U.S. PATENT DOCUMENTS

| | | | | |
|---|---|---|---|---|
| 2014/0004740 | A1 | 1/2014 | Uno et al. | |
| 2014/0011408 | A1 | 1/2014 | Nakayama et al. | |
| 2020/0203940 | A1* | 6/2020 | Miyamoto ..... | H02G 3/14 |

FOREIGN PATENT DOCUMENTS

| | | | |
|---|---|---|---|
| JP | 2008-258103 | A | 10/2008 |
| JP | 5201103 | B2 | 6/2013 |
| JP | 5995105 | B2 | 9/2016 |

OTHER PUBLICATIONS

Apr. 24, 2018 International Search Report issued in International Patent Application No. PCT/JP2018/014079.

* cited by examiner

CONNECTOR

The technology disclosed in the present application relates to a connector that is attached to a device.

BACKGROUND

Conventionally, among connectors that are attached to devices, a connector has been known that is provided with a main body made from a resin and formed into an annular shape, a terminal-equipped wire embedded in the main body that passes through the outer peripheral wall of the main body, and a metal shield shell that is fixed to the device, with a terminal being fixed, inside the main body, to a terminal fixing section on the device side (for example, see in JP Published Patent Application No. 2008-258103).

Specifically, the molded connector disclosed in JP Published Patent Application No. 2008-258103 is provided with a connector fitting section and cap fitting section (corresponding to the main body), a wire embedded in the main body that passes through the outer peripheral wall of the main body (corresponding to the terminal-equipped wire) and a metal shield shell fixed to the device, with a connection section of a terminal fitting (corresponding to the terminal) connected, inside the main body, by a bolt to a device-side terminal of the device-side connector (corresponding to the terminal fixing section on the device side).

In addition, the molded connector disclosed in JP Published Patent Application No. 2008-258103 is provided with a cap that covers an opening in the cap fitting section, and a bottom surface of the shield shell and a top surface of the cap are roughly in surface contact. Consequently, in this molded connector, even if the wires shake, tilting of the main body is suppressed by the shield shell. Through this, application of stress on the connecting section of the terminal fitting and the device-side terminal is suppressed, so that damage to the connection section of the terminal fitting or the device-side terminal is suppressed.

SUMMARY

However, there are concerns that when the bottom surface of the shield shell is in surface contact with the main body, water could accumulate between due to surface tension. In addition, surface contact requires a high degree of processing precision, creating the problem that the cost of producing the connector climbs.

Consequently, there are also cases in which a gap of a certain size is provided between the shield shell and the connector main body. However, when the gap is provided, the main body tilts and stress is applied to the terminal and the terminal fixing section when the wires shake, creating the concern that the terminal or the terminal fixing section could be damaged.

In this specification, a technology is disclosed that can suppress damage to the terminal or the terminal fixing section caused by shaking of the wires, even when there is a gap between the shield shell and the connector main body.

The connector disclosed in this specification is a connector attached to a device, the connector comprising: a main body made from resin and formed so as to have an annular shape; a terminal-equipped wire embedded in the main body so as to pass through the outer peripheral wall of the main body, the terminal-equipped wire being such that the terminal is fixed, inside the main body, to a terminal fixing section on the device side; and a shield shell made from metal that covers at least a portion of the main body, the shield shell being fixed to the device with a gap between the shield shell and the main body; wherein protrusions are provided on at least one of (i) a section of the shield shell covering the main body or (ii) a section of the main body covered by the shield shell, the protrusions protruding toward the other of these two components.

With the above-described connector, tilting of the main body is suppressed even when the wires shake, by protrusions provided on at least one of (i) the shield shell or (ii) the main body and abutting the other of these two components. Through this, even where there is a gap between the shield shell and the connector main body, damage to the terminal or the terminal fixing section caused by shaking of the wires can be suppressed.

In addition, the main body may include a flange that protrudes outward from the outer peripheral wall, the shield shell includes an opening and covers at least a portion of the flange when the main body is inserted into the opening, and the protrusions are provided on at least one of (i) a section of the shield shell covering the flange or (ii) a section of the flange being covered by the shield shell.

With the above-described connector, even when the main body itself (the part other than the flange) is not covered by the shield shell because the main body is inserted into the opening, tilting of the main body can be suppressed by the protrusions being provided on at least one of (i) the shield shell or (ii) the flange.

In addition, a plurality of protrusions may be provided, separated from each other in a peripheral direction of the opening.

With the above-described connector, a plurality of protrusions is provided, the protrusions being separated from each other in the peripheral direction of the opening, and through this, tilting of the main body can be suppressed with greater certainty compared to when only one protrusion is provided.

In addition, the number of protrusions may be at least three.

When the number of protrusions is two, there is a concern that tilting cannot be suppressed when the main body tilts around the straight line connecting the two protrusions, so preferably there are three or more protrusions in order to suppress tilting of the main body with greater certainty. With the above-described connector, tilting of the main body can be suppressed with greater certainty.

In addition, the protrusions may be provided on the shield shell.

The flange is made of resin, and consequently, there is a concern that when the protrusions are provided on the flange, the protrusions will be crushed when abutting the metal shield shell. With the above-described connector, the protrusions are provided on the shield shell, so crushing of the protrusions can be suppressed.

With the technology disclosed in this specification, damage to the terminal or the terminal fixing section caused by shaking of the wires can be suppressed even when there is a gap between the shield shell and the main body of the connector.

DETAILED DESCRIPTION OF EMBODIMENTS

Embodiment 1

Figure 1:
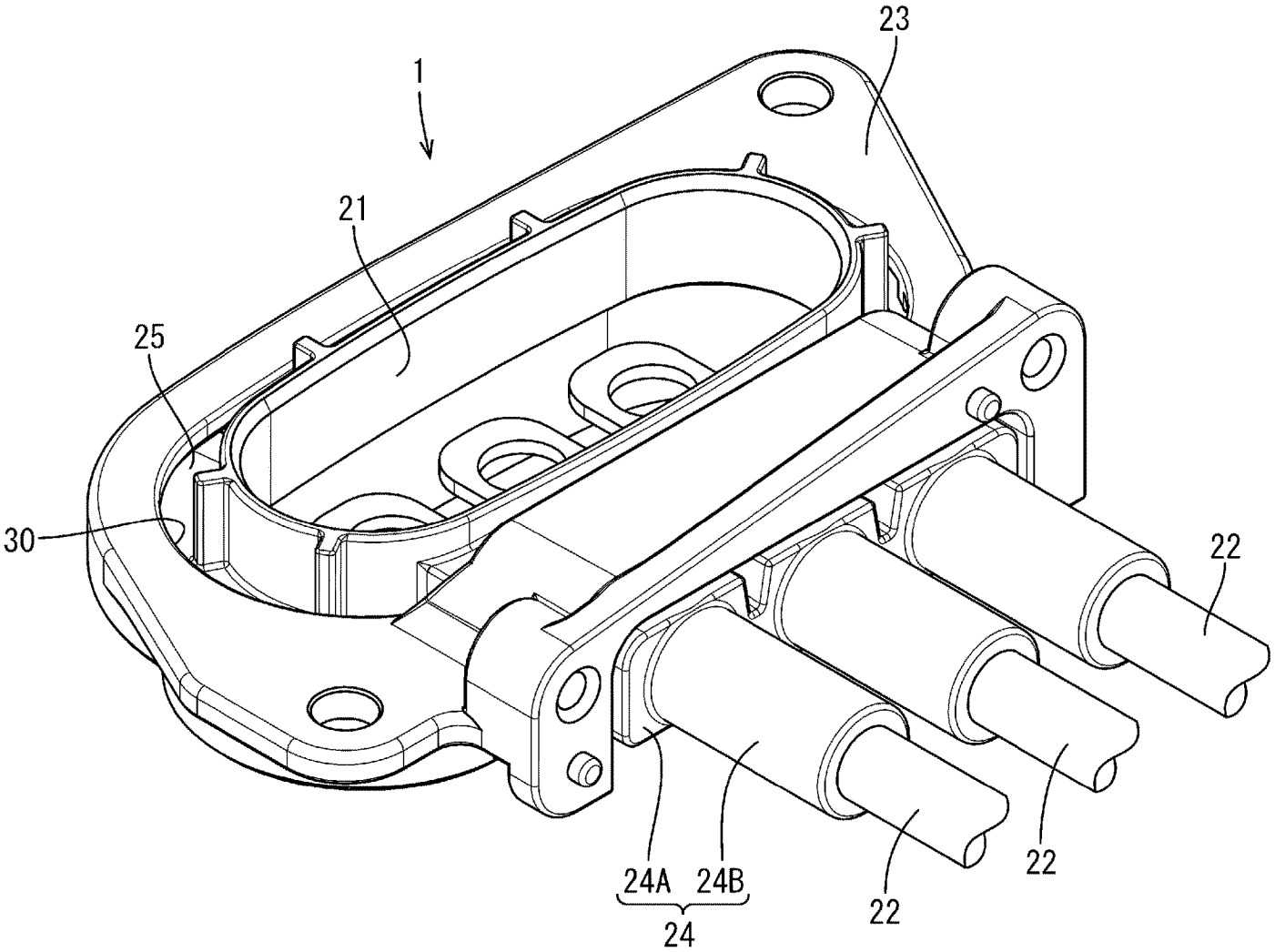
FIG. 1 is an oblique view of a connector according to embodiment 1.

Embodiment 1 will be described with reference to FIG. 1 through FIG. 4. In the explanation below, the upward and downward directions and the front and back directions are based on the upward and downward directions and front and back directions shown in FIG. 2, and the left and right directions are based on the left and right directions shown in FIG. 3.

(1) Overview of the Connector

First, an overview of a connector 1 according to embodiment 1 will be described with reference to FIG. 1. The connector 1 is attached to an inverter 2 (one example of a device, see FIG. 2) that is mounted in a vehicle such as an electric vehicle or a hybrid vehicle, and is used to electrically connect the inverter 2 and a three-phase motor. The connector 1 may also be attached to a three-phase motor.

The structure of the section in the inverter 2 to which the connector 1 is attached will be briefly described with reference to FIG. 2. A fitting hole 10 into which a main body 21 of the connector 1 is fitted is provided in the inverter 2. Inside the fitting hole 10, a metal terminal fixing section 11 is provided, and the connector 1 (but excluding a shield shell 23) is fastened by a bolt 12 to the terminal fixing section 11 of the inverter 2.

(2) Configuration of the Connector

Figure 2:
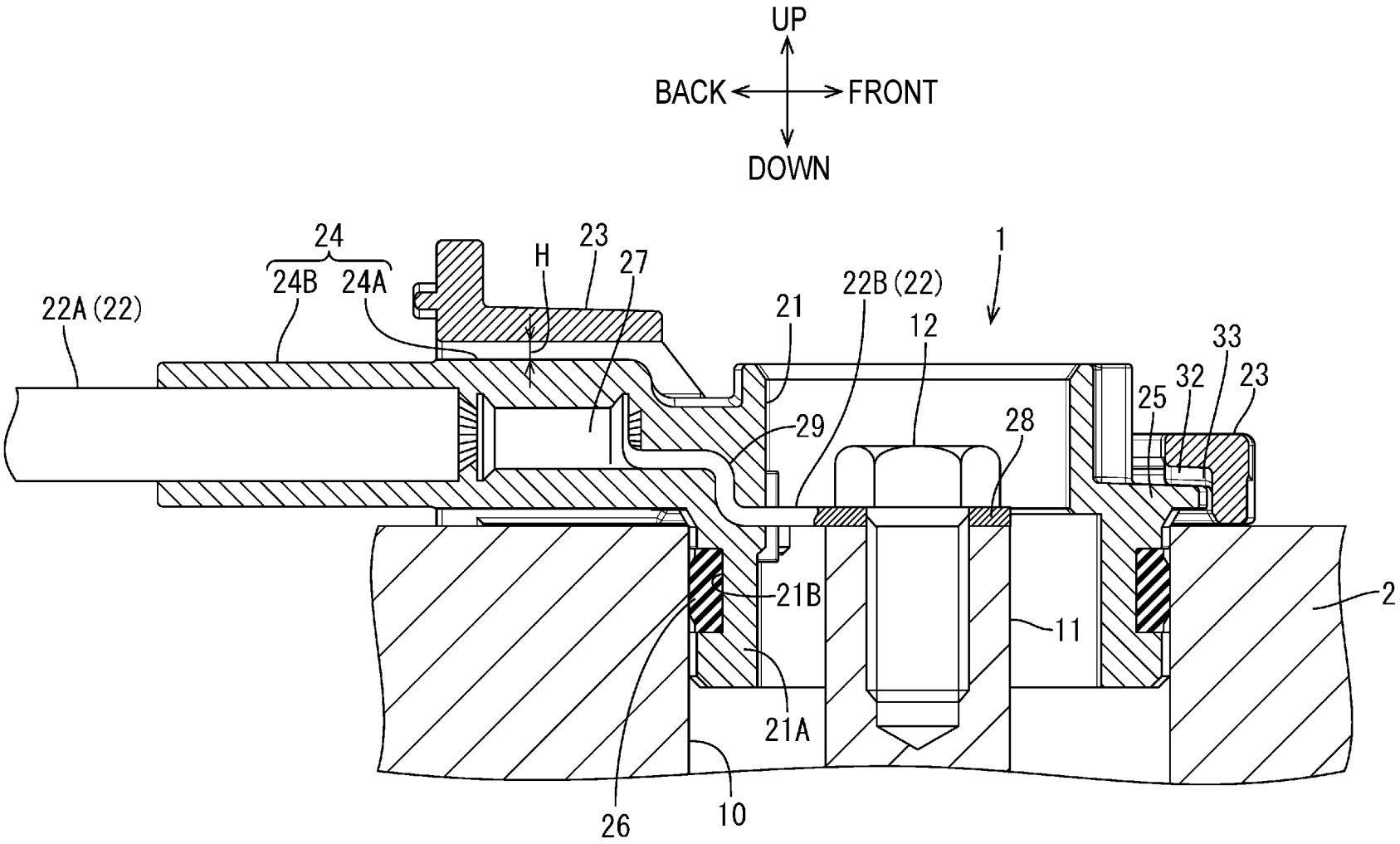
FIG. 2 is a cross-sectional view taken along line A-A in FIG. 4.

As shown in FIG. 1 and FIG. 2, the connector 1 comprises a main body 21 made of resin and formed so as to have an annular shape, three terminal-equipped wires 22 and a shield shell 23 that electrically shields the connector 1.

Figure 3:
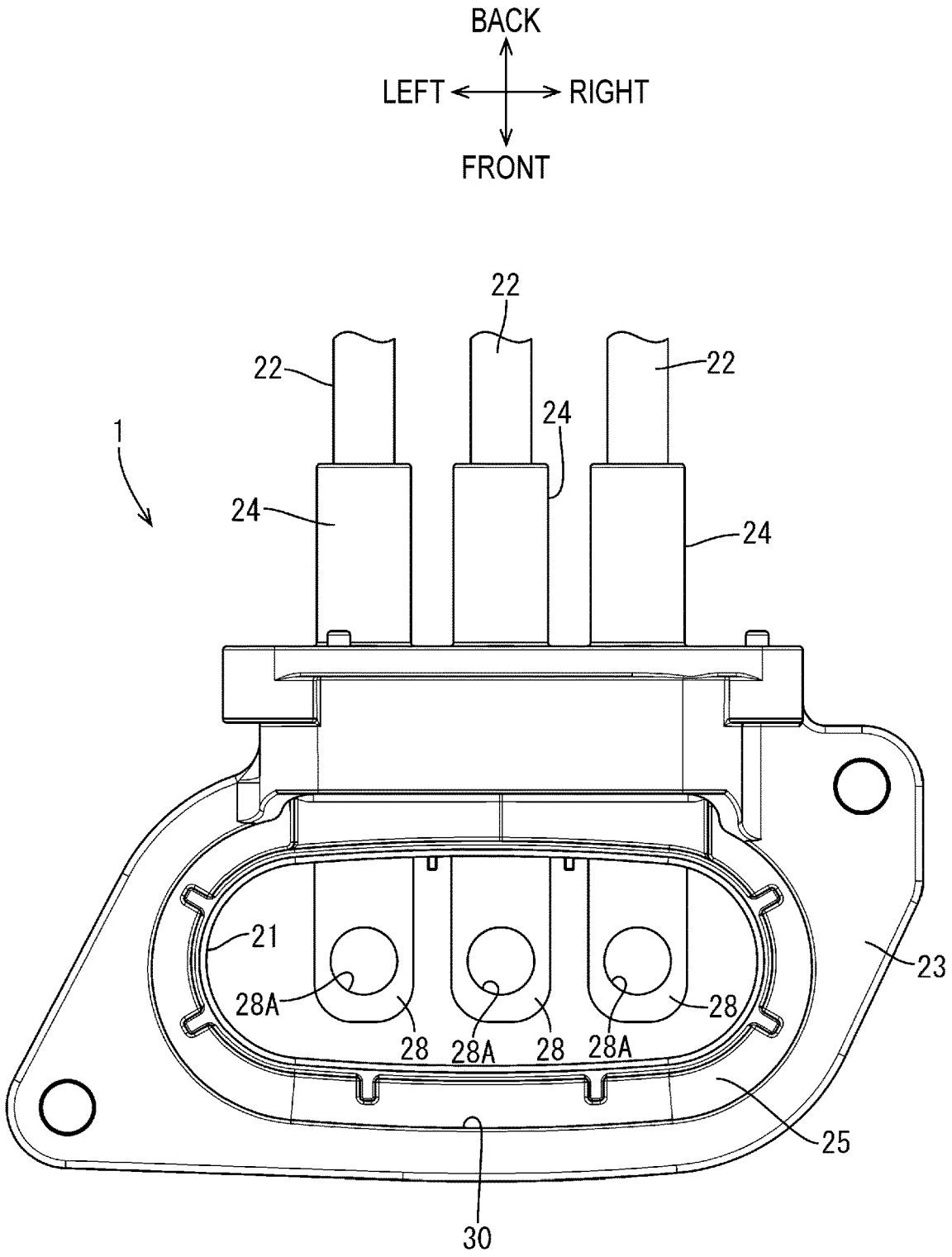
FIG. 3 is a top view of the connector.

As shown in FIG. 2 and FIG. 3, the main body 21 is formed so as to have a roughly elliptical hole, with three wire holding units 24 that protrude outward from the outer peripheral wall and a flange 25 that protrudes outward from the outer peripheral wall of the main body 21, excluding the section where the three wire holding units 24 are provided, the wire holding units 24 and the flange 25 being integrally formed. The top surface of the flange 25 is a roughly flat surface.

As shown in FIG. 2, in the main body 21, the side lower than the flange 25 comprises a fitting section 21A that fits into the fitting hole 10 of the inverter 2. An annular groove 21B is formed in the outer peripheral surface of the fitting section 21A, and an O-ring 26 that forms a watertight seal between the fitting section 21A and the inverter 2 is fitted into the groove 21B.

As shown in FIG. 1, the three wire holding units 24 each have a square columnar section 24A protruding in the shape of a square column from the outer peripheral surface of the main body 21, and a cylindrical section 24B extending in a cylindrical shape from the tip surface of the square columnar section 24A. Neighboring square columnar sections 24A are mutually connected in order to ensure strength.

As shown in FIG. 2, the terminal-equipped wires 22 have a covered wire 22A and a terminal fitting 22B that is crimped onto a core wire of a tip end of the covered wire 22A, and are embedded in the wire holding unit 24 and the main body 21 through molding in a state passing through the outer peripheral wall of the main body 21 and the wire holding unit 24.

The terminal fitting 22B is formed by bending a metal sheet, and has a barrel section 27 for crimping the core of the covered wire 22A, and a planar section 28 fixed to the terminal fixing section 11. As shown in FIG. 2, the terminal fitting 22B is bent into a key shape near the center in the front-to-back direction, forming a bent section 29. In addition, as shown in FIG. 3, a bolt insertion hole 28A into which the bolt 12 is inserted in order to fasten the terminal fitting 22B to the terminal fixing section 11 is formed in the planar section 28.

As shown in FIG. 3, an elliptical opening 30 into which the main body 21 (more specifically, the part of the main body 21 above the flange 25) is inserted is formed in the shield shell 23. The opening 30 is formed in a shape that is larger than the outer diameter of the main body 21 of the connector 1 (excluding the wire holding unit 24 and the flange 25), and smaller than the outer diameter of the flange 25.

In addition, as shown in FIG. 1 and FIG. 3, a portion of the shield shell 23 overlaps the square columnar sections 24A of the wire holding unit 24 when viewed from above. As shown in FIG. 1 and FIG. 2, in the shield shell 23 the portion that overlaps the square columnar sections 24A is taller than the portion that does not overlap the square columnar section 24A, in order to avoid the square columnar sections 24A.

Figure 4:
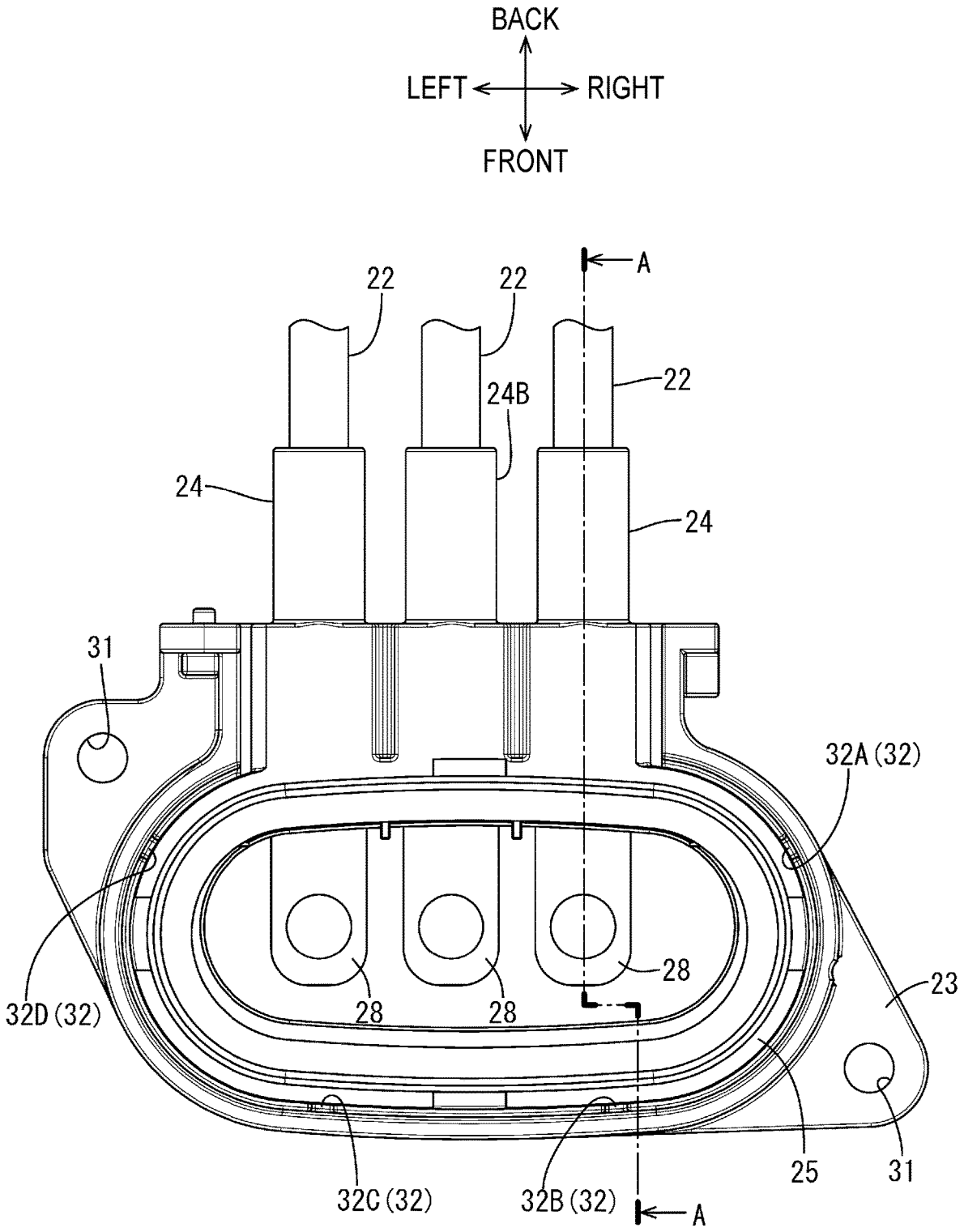
FIG. 4 is a bottom view of the connector.

In addition, as shown in FIG. 4, two bolt insertion holes 31 are formed in the shield shell 23 in the region that does not overlap with the flange 25 when viewed from the bottom side. The shield shell 23 is fastened to the inverter 2 by bolts inserted into these two bolt insertion holes 31 in a state in which the main body 21 is inserted into the inside of the opening 30.

As shown in FIG. 2, when the shield shell 23 is fastened to the inverter 2, a gap H is created between the shield shell 23 and the main body 21 of the connector 1.

Next, referencing FIG. 4, protrusions 32 (32A, 32B, 32C and 32D) formed on the bottom surface of the shield shell 23 will be described. Four protrusions 32 protruding toward the flange 25 are provided with spaces in between in the peripheral direction of the opening 30 in the section of the shield shell 23 covering the flange 25. In FIG. 4, only a portion of each of the protrusions 32 (the portion 33 that does not overlap the flange 25 in FIG. 2) can be seen because the flange 25 is below the shield shell 23.

The protrusions 32A and 32D are provided on the back side based on the fastening position of the terminal fittings 22B, and the protrusions 32B and 32C are provided on the front side. In addition, the two protrusions 32A and 32D provided on the back side are arranged on the two sides with the three wire holding units 24 interposed in between in the peripheral direction of the opening 30.

As shown in FIG. 2, when the shield shell 23 is fixed to the inverter 2, the bottom surface of each of the protrusions 32 is at a position that substantially abuts the flange 25.

(3) Action of the Protrusions

Next, the action of the protrusions 32 will be described with reference to FIG. 2. As described above, the connector 1 (but excluding the shield shell 23) is fastened by bolts 12 to the terminal fixing section 11 of the inverter 2, so when the terminal-equipped wires 22 are shaken upward by the vibrations of a vehicle, for example, the back side of the main body 21 tends to lift upward centered on the fastening position of the terminal fittings 22B.

However, because the protrusions 32A and 32D are provided in the shield shell 23, tilting of the main body 21 is suppressed by the protrusions 32A and 32D abutting the flange 25. Through this, the imposition of stress on the terminal fittings 22B and the terminal fixing section 11 is suppressed.

Conversely, when the terminal-equipped wires 22 are shaken downward, the front side of the main body 21 tends to lift upward centered on the fastening position of the terminal fitting 22B. However, the protrusions 32B and 32C are provided on the shield shell 23, so tilting of the main body 21 is suppressed by the protrusions 32B and 32C abutting the flange 25. Through this, the imposition of stress on the terminal fittings 22B and the terminal fixing section 11 is suppressed.

(4) Effect of the Embodiment

With the connector 1 according to embodiment 1 as described above, even if the terminal-equipped wires 22 are shaken, the protrusions 32 provided on at least one of (i) the shield shell 23 or (ii) the main body 21 abut the other of these two components, and through this tilting of the main body 21 is suppressed. Through this, even if there is a gap H between the shield shell 23 and the main body 21 of the connector 1, damage to the terminal fitting 22B or the terminal fixing section 11 caused by shaking of the terminal-equipped wires 22 can be suppressed.

In addition, with the connector 1, even when the main body 21 is inserted into the opening 30 and the main body 21 itself is not covered by the shield shell 23, by providing the protrusions 32 on at least one of (i) the shield shell 23 or (ii) the flange 25, tilting of the main body 21 can be suppressed.

In addition, with the connector 1, by providing a plurality of the protrusions 32 with spacing between each other in the peripheral direction of the opening 30, tilting of the main body 21 can be suppressed with greater certainty than in the case of only one protrusion 32.

In addition, with the connector 1, there are at least three of the protrusions 32. When there are two of the protrusions 32, there is a concern that tilting cannot be suppressed when the main body 21 starts to tilt about the line connecting these two protrusions 32, so in order to suppress tilting of the main body 21 with greater certainty, having three or more of the protrusions 32 is preferable. With the connector 1, there are at least three of the protrusions 32, so tilting of the main body 21 can be suppressed with greater certainty.

In addition, with the connector 1, the protrusions 32 are provided in the shield shell 23. The flange 25 is made from resin, so there is a concern that if the protrusions 32 are provided on the flange 25, the protrusions 32 will be crushed upon abutting the metal shield shell 23. With the connector 1, the protrusions 32 are provided on the shield shell 23, so it is possible to suppress crushing of the protrusions 32.

Other Embodiments

The technology disclosed in this specification is not limited to the embodiment described with the above description and the drawings, and the following embodiments, for example, are also included within the technical scope of this specification.

(1) In the above-described embodiment, an example was described for a case in which the protrusions 32 are provided on the shield shell 23. In contrast, the protrusions 32 may be provided on the flange 25, or the protrusions 32 may be provided on the both the shield shell 23 and the flange 25.

(2) In the above-described embodiment, an example was described for a case in which the opening 30 is provided in the shield shell 23, but when the entirety of the main body 21 is covered by the shield shell 23, the opening 30 need not be provided.

(3) In the above-described embodiment, an example was described for a case in which the four protrusions 32 are arranged with spacing between each other in the peripheral direction of the opening 30, but the number and arrangement of the protrusions 32 is not limited to the above-described example and can be appropriately selected.

(4) In the above-described embodiment, an example was described for a case in which the terminal fittings 22B are fastened by bolts 12 to the terminal fixing sections 11, but the terminal fittings 22B may be fixed by welding, brazing or the like to the terminal fixing section 11.

EXPLANATION OF SYMBOLS

1 Connector
2 Inverter (one example of a device)
11 Terminal fixing section
21 Main body
22 Terminal-equipped wire
22B Terminal fitting (one example of a terminal)
23 Shield shell
25 Flange
30 Opening
32 (32A, 32B, 32C, 32D) Protrusions
H Gap

What is claimed is:

1. A connector attached to a device, the connector comprising:

a main body made from resin and having an annular shape;

a wire including a terminal, the wire being embedded in the main body so as to pass through an outer peripheral wall of the main body, and the terminal being fixed to a terminal fixing section on the device inside the main body; and a shield shell made from metal that covers at least a portion of the main body, the shield shell being fixed to the device, a gap existing between the shield shell and the main body in a state in which the shield shell is fixed to the device, wherein:

protrusions are provided on at least one of (i) a section of the shield shell covering the main body or (ii) a section of the main body covered by the shield shell, the protrusions protruding toward the section of the shield shell or the section of the main body;

the main body includes a flange protruding outward from the outer peripheral wall, the flange being covered by a portion of the shield shell; and in an area in which the shield shell covers the flange, the protrusions are spaced from each other along a periphery of the shield shell, the periphery surrounding a fastening position where the terminal and the terminal fixing section are fastened together.

2. The connector according to claim 1, wherein a number of the protrusions is at least three.

3. The connector according to claim 1, wherein the protrusions are provided on the shield shell.

4. The connector according to claim 1, where at least one of the protrusions is positioned on a first side of a line that (i) passes through the fastening position, as seen in plan view, and (ii) is perpendicular to a longitudinal axis of the wire at the main body, and at least one other of the protrusions is positioned on a second side of the line, opposite to the first side.

5. The connector according to claim 1, wherein:

the shield shell includes an opening and covers at least a portion of the flange when the main body is inserted into the opening; and the protrusions are provided on at least one of (i) the portion of the shield shell covering the flange or (ii) the section of the flange being covered by the shield shell.

6. The connector according to claim 5, wherein the protrusions are spaced from each other in a peripheral direction of the opening.

* * * * *